US006720754B2

(12) United States Patent
Nakashimo

(10) Patent No.: US 6,720,754 B2
(45) Date of Patent: Apr. 13, 2004

(54) VOLTAGE REGULATOR

(75) Inventor: Takao Nakashimo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/287,071

(22) Filed: Nov. 4, 2002

(65) Prior Publication Data

US 2003/0090251 A1 May 15, 2003

(30) Foreign Application Priority Data

Nov. 15, 2001 (JP) ..... 2001-350650
Nov. 16, 2001 (JP) ..... 2001-352143
Oct. 4, 2002 (JP) ..... 2002-292693

(51) Int. Cl.[7] ..... G05F 1/40
(52) U.S. Cl. ..... 323/282
(58) Field of Search ..... 323/282, 283, 323/284, 280, 281, 351

(56) References Cited

U.S. PATENT DOCUMENTS 4,160,201 A * 7/1979 Ahmed ..... 323/226
5,828,206 A * 10/1998 Hosono et al. ..... 323/273
6,509,723 B2 * 1/2003 Matsushita ..... 323/281
6,583,607 B1 * 6/2003 Marty et al. ..... 323/273
6,630,903 B1 * 10/2003 Hann et al. ..... 342/175

* cited by examiner

*Primary Examiner*—Adolf Berhane
(74) *Attorney, Agent, or Firm*—Adams & Wilks

(57) ABSTRACT

There is provided a voltage regulator in which a ratio of a maximum current and a short circuit current is adjusted so that the maximum current is greatly increased and a short circuit current is made small. A first current limiting circuit for limiting a current value of an output voltage terminal is composed of P-channel MOS transistors (2, 4), an N-channel MOS transistor (3), and resistors (21 and 22). A second current limiting circuit for detecting a reduction in voltage of the output voltage terminal and limiting a current value of the output voltage terminal is composed of P-channel MOS transistors (2, 4), an N-channel MOS transistor (3), and resistors (20, 21, and 22). By using these circuits, the maximum current can be greatly increased and the short circuit current can be reduced.

10 Claims, 7 Drawing Sheets

VOLTAGE REGULATOR

BACKGROUND OF THE INVENTION

1. Field of the Invention

The present invention relates to a circuit voltage regulator.

2. Description of the Related Art

FIG. 2 is a block diagram showing a configuration example of a conventional voltage regulator. A source terminal and a drain terminal of a P-channel MOS transistor 1 are connected in series between an input terminal 101 and an output terminal 103. A gate terminal of the P-channel MOS transistor 1 is connected with an output terminal of a differential amplifying circuit 10. Respective input terminals of the differential amplifying circuit 10 are connected with an output voltage terminal of a reference voltage source 11 and an output voltage terminal of a voltage dividing circuit 12.

The differential amplifying circuit 10 compares a voltage of the reference voltage source 11 with an output voltage of the voltage dividing circuit 12, keeps the voltage of the output voltage terminal of the reference voltage source 11 and the voltage of the output voltage terminal of the voltage dividing circuit 12 to the same voltage, and controls a gate voltage of the P-channel MOS transistor 1 so as to keep a voltage of the output terminal 103 to be a predetermined value.

In order to limit a current value in the case where the output terminal 103 of the voltage regulator is short-circuited and to prevent the P-channel MOS transistor 1 from overheating, a P-channel MOS transistor 2 having a gate terminal and a source terminal which are common to the gate terminal and the source terminal of the P-channel MOS transistor 1, a resistor 21 inserted between the output terminal and the drain terminal of the P-channel MOS transistor 2, a resistor 22 connected with the input terminal 101, and an N-channel MOS transistor 3 in which the drain terminal is connected with the resistor 22 in series are provided. The output terminal 103 is connected with the drain terminal of the N-channel MOS transistor 3. The gate terminal of the N-channel MOS transistor 3 is connected with the drain terminal of the P-channel MOS transistor 2. A base terminal of the N-channel MOS transistor 3 is connected with a ground terminal 102. The drain terminal of the N-channel MOS transistor 3 is connected with a gate terminal of a P-channel MOS transistor 4. A source terminal of the P-channel MOS transistor 4 is connected with the input terminal 101. The drain terminal of the P-channel MOS transistor 4 is connected with the gate terminal of the P-channel MOS transistor 1.

When a current flows into the P-channel MOS transistor 1, a current flows into the P-channel MOS transistor 2 based on a ratio determined by a ratio of a channel length and a channel width with respect to the P-channel MOS transistor 1 and the P-channel MOS transistor 2.

A voltage between both ends of the resistor 21 is inputted to an invert circuit composed of the resistor 22 and the N-channel MOS transistor 3 and the output of the invert circuit is inputted to the gate of the P-channel MOS transistor 4 inserted between the gate and the source of the P-channel MOS transistor 1 so that the P-channel MOS transistor 4 is turned ON/OFF. Thus, a voltage between the gate and the source of the P-channel MOS transistor 1 can be adjusted so that a value of a current flowing into the output terminal 103 can be controlled to a specified value.

Next, circuit operation will be described. If the output terminal 103 is short-circuited with the ground terminal 102, a large current tends to flow into the P-channel MOS transistor 1. At this time, a current which is determined by a ratio of a channel length and a channel width with respect to the P-channel MOS transistor 1 and the P-channel MOS transistor 2 flows into the P-channel MOS transistor 2. The voltage between both ends of the resistor 21 is risen proportional to the current value. When the voltage exceeds a threshold voltage of the N-channel MOS transistor 3, the N-channel MOS transistor 3 is turned ON and a voltage between the gate and the source of the P-channel MOS transistor 4 is increased. Thus, the P-channel MOS transistor 4 tends toward an ON state.

If the P-channel MOS transistor 4 is shifted toward an ON state, a gate voltage of the P-channel MOS transistor 1 approaches a potential of the input terminal 101. Thus, a voltage between the gate and the source of the P-channel MOS transistor 1 becomes smaller so that it is shifted toward an OFF state. By such operation, a current flowing into the P-channel MOS transistor 1 is limited and decreased.

FIG. 3 shows a characteristic between an output current flowing into the output terminal 103 and an output current at this time. As shown in FIG. 3, the output current is reduced from a maximum current Im as the output voltage is reduced. Then, when the output voltage is zero, that is, the output terminal 103 is short-circuited with the ground terminal 102, it becomes a current value of shirt circuit current Is. A mechanism by which this characteristic is realized is obtained due to the fact that a source potential of the N-channel MOS transistor 3 is different from a base potential so that a threshold voltage of the N-channel MOS transistor 3 is varied by a back gate effect. When the output voltage of the voltage regulator is reduced, the threshold voltage of the N-channel MOS transistor 3 becomes lower by a back gate effect.

When the threshold voltage of the N-channel MOS transistor 3 becomes lower by a back gate effect, even if a current flowing into the resister 21 is small, the N-channel MOS transistor 3 is turned ON. Thus, a current flowing into the P-channel MOS transistor 1 becomes smaller. Accordingly, a characteristic as shown in FIG. 3 is obtained, which is expressed by a fixed straight line and subsequent turn-back slant line (for example, see patent reference 1).

Patent Reference: JP 07-74976 B (FIGS. 1 and 3)

The maximum current Im is a current used in a device connected with the output terminal 103. Thus, it is required that this current is maximized. In addition, a short circuit current Is is a current produced at a time when the output terminal is short-circuited with the ground terminal. Thus, it is required that this current is minimized.

However, according to the voltage regulator having the above configuration, a ratio of Im and Is is dependent on a back gate effect of the N-channel MOS transistor 3. Thus, the ratio of the maximum current Im and the short circuit current Is of the voltage regulator can not be adjusted. Accordingly, there is a problem that the maximum current cannot be made large and the short circuit current cannot be made small.

SUMMARY OF THE INVENTION

In order to solve the above-mentioned problem, according to a voltage regulator of the present invention, the configuration is used in which a resistance value for detecting an output current is changed by an output voltage and a limited current can be changed according to the output voltage.

Therefore, according to the invention of the present application, there is provided a voltage regulator for controlling a current flowing into an output voltage terminal in accordance with an output voltage, comprising:

a first MOS transistor having a first conductivity type in which a source terminal thereof is connected with an input voltage terminal and a drain terminal thereof is connected with the output voltage terminal;

a differential amplifying circuit having two input terminals in which an output terminal thereof is connected with a gate terminal of the first MOS transistor;

a first reference voltage source which is connected between one of the input terminals of the differential amplifying circuit and a ground terminal and in which an output terminal thereof is connected with the one input terminal of the differential amplifying circuit; and a voltage dividing circuit which is connected between the output voltage terminal and the ground terminal and in which an output voltage terminal thereof is connected with the other input terminal of the differential amplifying circuit.

The voltage regulator of the present invention further comprises:

a second MOS transistor having the first conductivity type in which a gate terminal and a source terminal thereof are connected with the gate terminal and the source terminal of the first MOS transistor, which are common to each other, respectively; and a first resistor connected between the output voltage terminal and a drain terminal of the second MOS transistor.

The voltage regulator of the present invention further comprises:

an MOS transistor having a second conductivity type in which a source terminal thereof is connected with the output voltage terminal, a gate terminal thereof is connected with the drain terminal of the second MOS transistor, and a base terminal thereof is connected with the ground terminal; and a second resistor connected between the input voltage terminal and a drain terminal of the MOS transistor having the second conductivity type.

The voltage regulator of the present invention further comprises:

a third MOS transistor having the first conductivity type in which a source terminal thereof is connected with the input voltage terminal, a gate terminal thereof is connected with the drain terminal of the MOS transistor having the second conductivity type, and a drain terminal thereof is connected with the gate terminal of the first MOS transistor;

a third resistor connected between the first resistor and the output voltage terminal; and a fourth MOS transistor having the first conductivity type in which a drain terminal and a source terminal thereof are connected with the third resistor in parallel.

Further, the voltage regulator of the present invention is characterized in that a voltage of a gate terminal of the fourth MOS transistor is a voltage lower than a specified output voltage.

Further, there is provided a voltage regulator according to a first aspect of the present invention, characterized in that the gate terminal of the fourth MOS transistor is connected with the ground terminal.

Further, there is provided a voltage regulator, characterized in that the gate terminal of the fourth MOS transistor is connected with the output terminal of the voltage dividing circuit.

Further, there is provided a voltage regulator further comprising a second reference voltage source in which a reference voltage (V1) lower than a specified output voltage is set, characterized in that the gate terminal of the fourth MOS transistor is connected with the second reference voltage source.

Further, according to the invention of the present application, there is provided a voltage regulator for controlling a current flowing into an output voltage terminal in accordance with an output voltage, comprising a first MOS transistor having a first conductivity type in which a source terminal thereof is connected with an input voltage terminal and a drain terminal thereof is connected with the output voltage terminal.

The voltage regulator of the present invention further comprises:

a voltage dividing circuit connected between a ground terminal and the output voltage terminal;

a reference voltage source;

a differential amplifying circuit in which an output terminal thereof is connected with a gate terminal of the first MOS transistor and two input terminals thereof are connected with an output terminal of the reference voltage source and an output voltage terminal of the voltage dividing circuit, respectively;

a first current limiting circuit for limiting a current value of the output voltage terminal; and a voltage detector for detecting a reduction in voltage of the output voltage terminal.

The voltage regulator of the present invention is characterized by further comprising:

a second current limiting circuit for limiting a current value of the output voltage terminal to a limited current value or smaller of the first current limiting circuit; and a switch element for switching from the first current limiting circuit to the second current limiting circuit when the voltage of the output voltage terminal which is detected by the voltage detector is a specified voltage or lower.

Further, the second current limiting circuit includes:

a second MOS transistor having the first conductivity type in which a source terminal and a gate terminal thereof are connected with the input voltage terminal and the output terminal of the differential amplifying circuit, respectively; and a third MOS transistor having the first conductivity type in which a source terminal, a drain terminal, and a base terminal thereof are connected with the input voltage terminal, the output terminal of the differential amplifying circuit, and the ground terminal, respectively.

The second current limiting circuit further includes:

an MOS transistor having a second conductivity type in which a source terminal, a gate terminal, and a drain terminal thereof are connected with the output voltage terminal, the drain terminal of the second MOS transistor, and a gate terminal of the third MOS transistor, respectively;

first and third resistors connected in series between the drain terminal of the second MOS transistor and the output voltage terminal, the first resistor being connected with a drain terminal of the second MOS transistor; and a second resistor connected between the input voltage terminal and the gate terminal of the third MOS transistor.

Further, the present invention is characterized in that the switch element is connected with the third resistor in series, and that the first current limiting circuit corresponds to the second current limiting circuit produced by short-circuiting the third resistor by the switch element.

Further, the switch element includes a fourth MOS transistor having the first conductivity type. A drain terminal and a source terminal of the fourth MOS transistor are connected with the output voltage terminal and the first resistor, respectively. Further, the present invention is characterized in that:

the voltage detector includes a voltage comparator and a reference voltage source;

the reference voltage source is connected with the ground terminal;

two input terminals of the voltage comparator are connected with the reference voltage source and the output voltage terminal, respectively; and an output terminal of the voltage comparator is connected with a gate terminal of the fourth MOS transistor.

Further, a voltage regulator according to the present invention is characterized in that a base terminal of the MOS transistor having the second conductivity type is connected with the output voltage terminal.

Further, a voltage regulator according to the present invention is characterized in that:

the source terminal and the base terminal of the MOS transistor having the second conductivity type are connected with the ground terminal; and the first and third resistors are connected in series between the ground terminal and the drain terminal of the second MOS transistor.

Further, according to the present invention, there is provided a voltage regulator, comprising:

an input terminal to which an input voltage is applied;

an output terminal from which an output voltage is outputted;

a ground terminal;

a voltage detecting circuit for outputting a voltage detection signal in response to a signal of the output terminal;

a voltage dividing circuit for dividing a voltage between the output terminal and the ground terminal;

a reference voltage source;

a differential amplifying circuit for outputting a signal in response to an output of the voltage dividing circuit and an output of the reference voltage source; and a resistor circuit in which a resistance is changed in response to the voltage detection signal from the voltage detecting circuit.

The voltage regulator of the present invention further comprises:

a first current limiting circuit in which an input is connected with the input terminal and an output is connected with the resistor circuit and which is controlled in response to an output of the differential amplifying circuit, the resistor circuit being connected between the first current limiting circuit and the output terminal; and a second current limiting circuit in which an input is connected with the input terminal and an output is connected with the output terminal and which is controlled in response to the output of the differential amplifying circuit.

Further, the voltage regulator of the present invention is characterized in that the resistor circuit includes:

an invert circuit for outputting a signal in response to an output of the first current limiting circuit; and a switch element which is connected between the input terminal and the differential amplifying circuit and controlled in response to an output of the invert circuit.

DETAILED DESCRIPTION OF THE PREFERRED EMBODIMENTS

Figure 1:
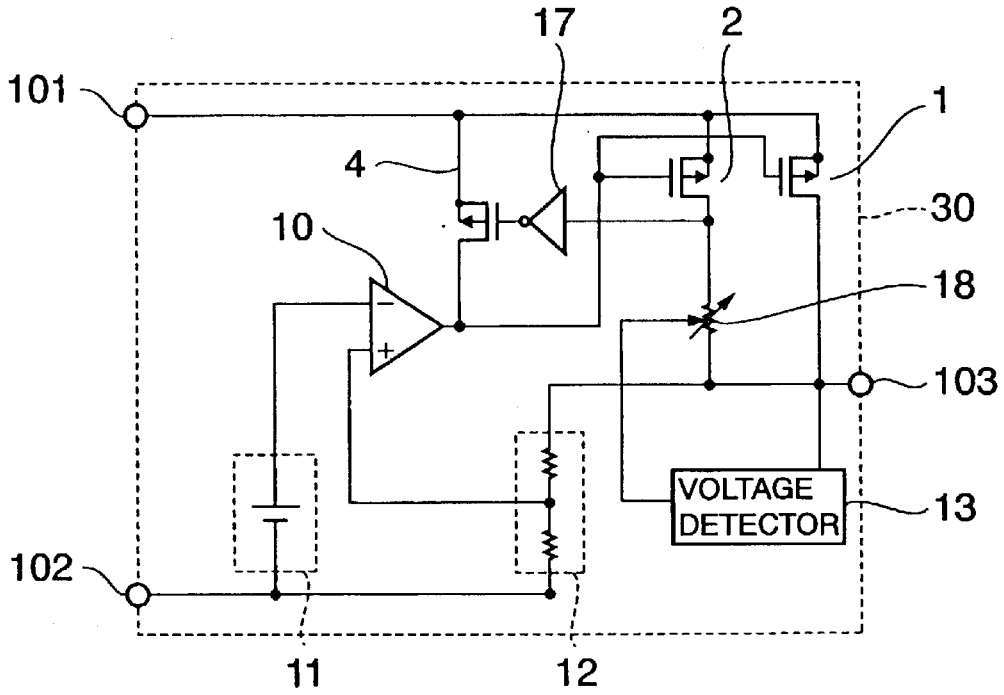
FIG. 1 is a circuit block diagram showing a configuration example of a voltage regulator according to the present invention.
Figure 2:
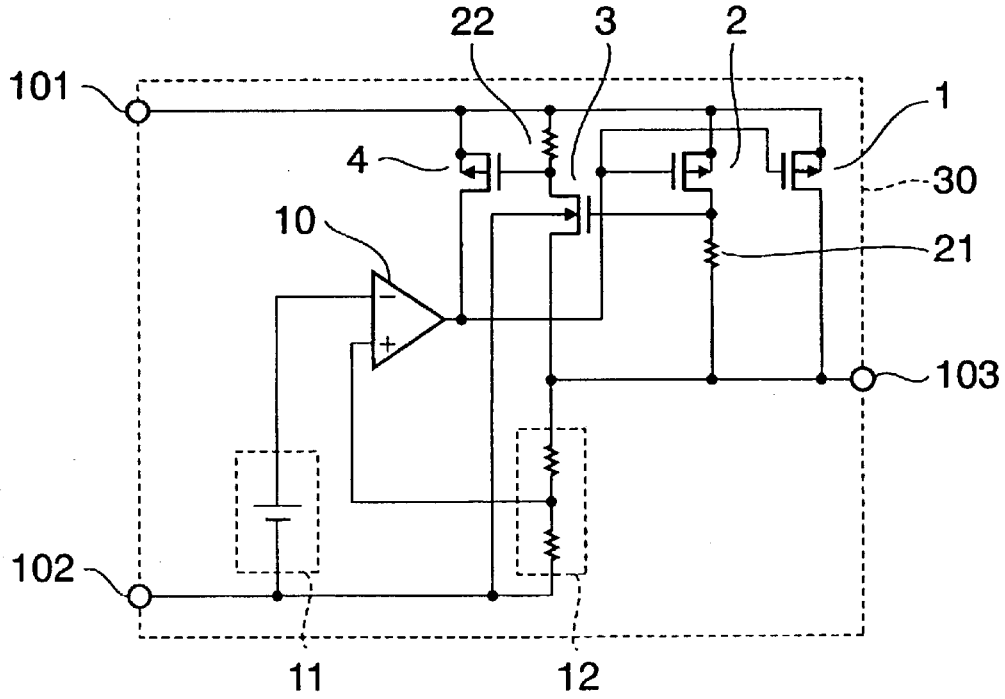
FIG. 2 PRIOR ART
FIG. 2 is a circuit block diagram showing a configuration example of a conventional voltage regulator.
Figure 3:
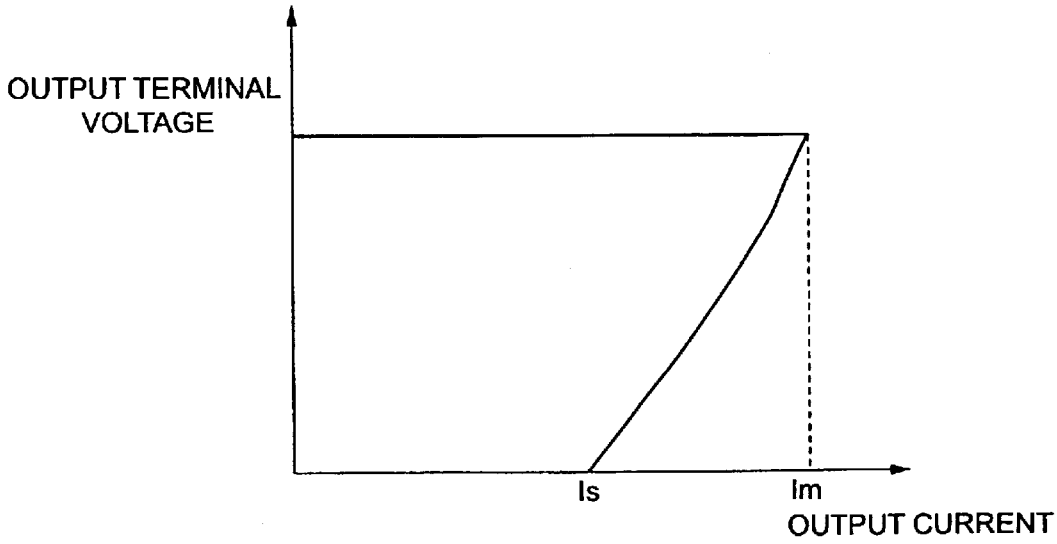
FIG. 3 PRIOR ART
FIG. 3 shows a relationship between an output voltage and an output current in the conventional voltage regulator.

Hereinafter, embodiments of the present invention will be described with reference to the drawings. FIG. 1 is a circuit block diagram showing a configuration example of a voltage regulator according to the present invention. The description related to the same portions as those in FIG. 2 is omitted here. Instead of the resistor 21, a variable resistor 18 is connected between the P-channel MOS transistor 2 and an output terminal 103 in the conventional voltage regulator shown in FIG. 2.

A voltage detector 13 detects a voltage of the output terminal 103 and outputs a control signal for controlling the variable resistor 18 when an output voltage becomes a specified voltage or higher.

Figure 4:
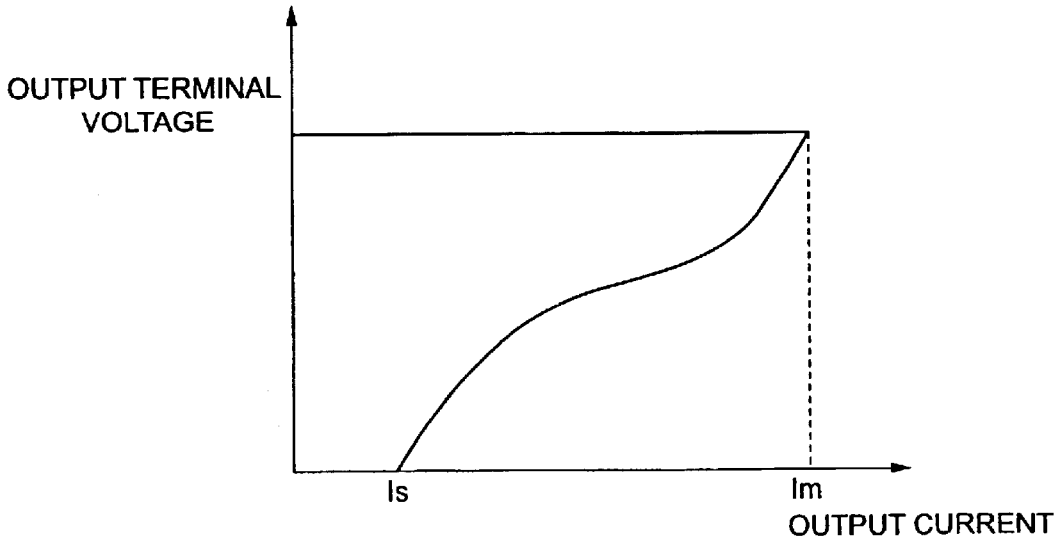
FIG. 4 shows a relationship between an output voltage and an output current in the voltage regulator according to the present invention.

Hereinbelow, the operation of the voltage regulator of FIG. 1 is described with reference to FIG. 4 showing a relationship between an output voltage and an output current. When a load into which a current larger than a specified current flows is connected with the output terminal 103, a large current tends to flow into the P-channel MOS transistor 1. Thus, a current which is determined by a channel length and a channel width with respect to the P-channel MOS transistor 1 and the P-channel MOS transistor 2 flows into the P-channel MOS transistor 2. Accordingly, an input voltage of an invert circuit 17 is risen proportional to the current value. When the voltage exceeds a threshold voltage of the invert circuit 17, as in the conventional example shown in FIG. 2, a voltage between the gate and the source of the P-channel MOS transistor 1 becomes smaller so that it tends toward an OFF state. At this time, a voltage between the gate and the source of the N-channel MOS transistor 3 becomes (resistance value of variable resistor 18)×(value of current flowing into P-channel MOS transistor 2).

When the output terminal voltage of the voltage regulator is reduced, the voltage detector 13 detects that and changes a resistance value of the variable resistor 18. At this time, when it is set such that the resistance value of the variable resistor 18 is increased as the output terminal voltage is reduced, if the output terminal voltage is reduced, even in the case of the same output current, a voltage between both ends of the variable resistor 18 is increased so that an input voltage of an invert circuit 17 is increased. Thus, a voltage between the gate and the source of the P-channel MOS transistor 4 is increased. Accordingly, a voltage between the gate and the source of the P-channel MOS transistor 1 becomes smaller so that the P-channel MOS transistor 1 further approaches an OFF state. As a result, a relationship between the output current and the output voltage has such a characteristic as shown in FIG. 4.

Figure 5:
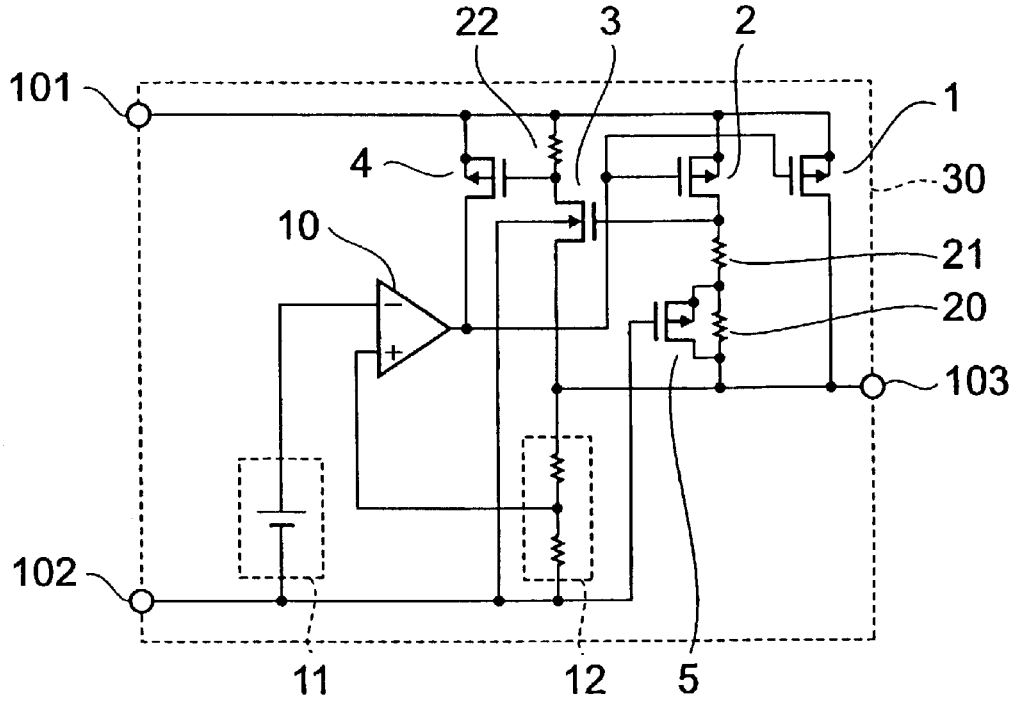
FIG. 5 is a circuit block diagram showing a configuration example of the voltage regulator according to the present invention.

FIG. 5 shows an embodiment of the configuration example shown in FIG. 1. Hereinafter, the embodiment shown in FIG. 5 will be described.

The description related to the same portions as those in FIG. 2 is omitted here. A resistor 20 is connected between the resistor 21 and the output terminal 103. The drain terminal and the source terminal of a P-channel MOS transistor 5 are connected with the resistor 20 in parallel. The gate terminal of the P-channel MOS transistor 5 is connected with the ground terminal 102. The invert circuit 17 is composed of a resistor 22 and an N-channel MOS transistor 3.

When a load into which a current larger than a specified current flows is connected with the output terminal 103, a large current tends to flow into the P-channel MOS transistor 1. Thus, a current which is determined by a channel length and a channel width with respect to the P-channel MOS transistor 1 and the P-channel MOS transistor 2 flows into the P-channel MOS transistor 2. Accordingly, a voltage between the gate and the source of the N-channel MOS transistor 3 is risen proportional to the current value. When the voltage exceeds a threshold voltage of the N-channel MOS transistor 3, as in the conventional example shown in FIG. 2, a voltage between the gate and the source of the P-channel MOS transistor 1 becomes smaller so that it tends toward an OFF state. At this time, if the output voltage is equal to or larger than a threshold voltage of the P-channel MOS transistor 5, the P-channel MOS transistor 5 is being turned ON.

When the output voltage of the voltage regulator is reduced so that a voltage between the gate and the source of the P-channel MOS transistor 5 becomes lower, an ON resistance of the P-channel MOS transistor 5 is increased. Thus, even in the case of the same output current, a voltage between the gate and the source of the N-channel MOS transistor 3 is increased so that a voltage between the gate and the source of the P-channel MOS transistor 4 is increased. Accordingly, a voltage between the gate and the source of the P-channel MOS transistor 1 becomes smaller so that the P-channel MOS transistor 1 further approaches an OFF state. The load connected with the output terminal acts such that the P-channel MOS transistor 1 is further shifted toward an OFF state as the output voltage is reduced. As a result, a relationship between the output current and the output voltage has the characteristic as shown in FIG. 4.

Figure 6:
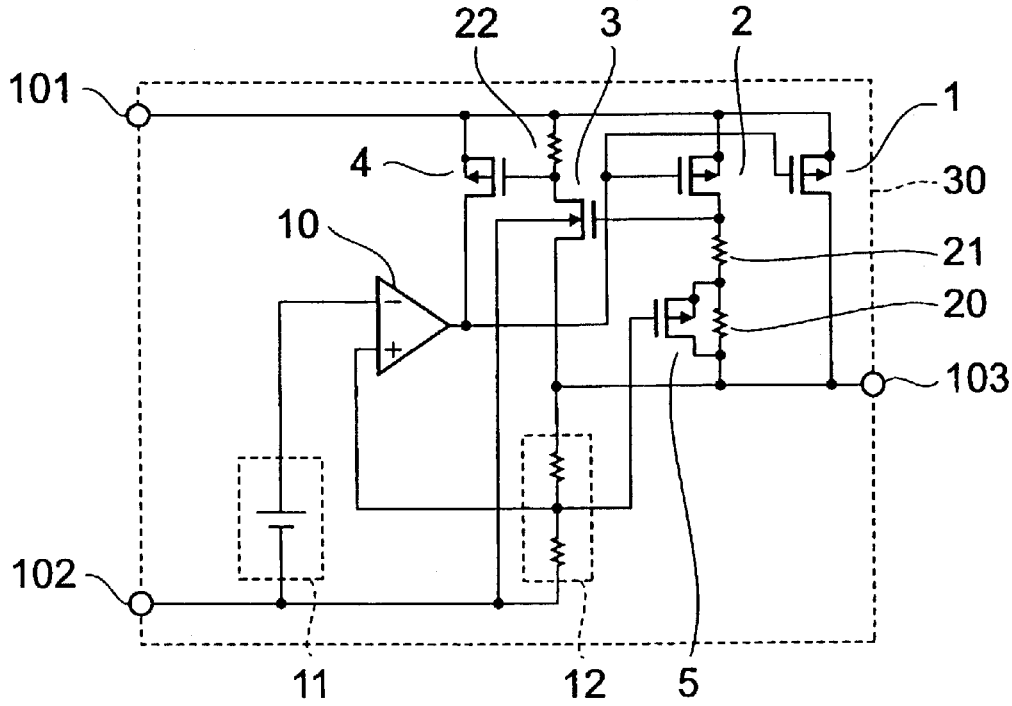
FIG. 6 is a circuit block diagram showing a configuration example of the voltage regulator according to the present invention.
Figure 7:
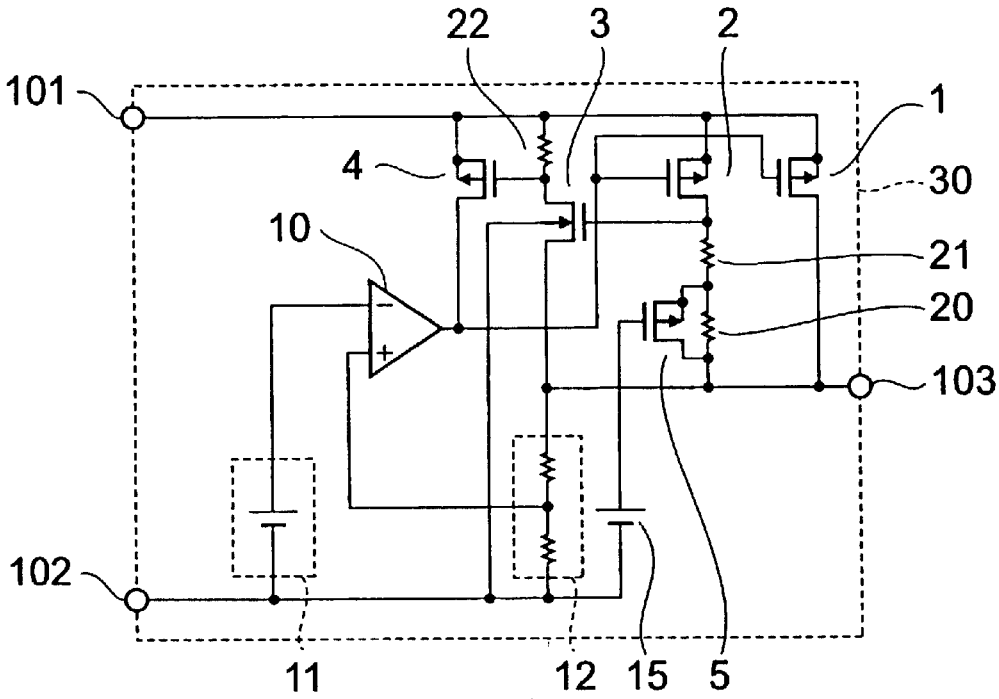
FIG. 7 is a circuit block diagram showing a configuration example of the voltage regulator according to the present invention.

In the embodiment shown in FIG. 5, the gate terminal of the P-channel MOS transistor 5 may be connected with the output terminal of the voltage dividing circuit 12 as shown in FIG. 6. In addition, as shown in FIG. 7, the gate terminal of the P-channel MOS transistor 5 may be connected with a reference voltage source 15. In either case, a voltage between the gate and the source of the P-channel MOS transistor 5 is reduced as a voltage of the output terminal 103 is reduced. Thus, a relationship between the output voltage and the output voltage has the characteristic as shown in FIG. 4.

Figure 8:
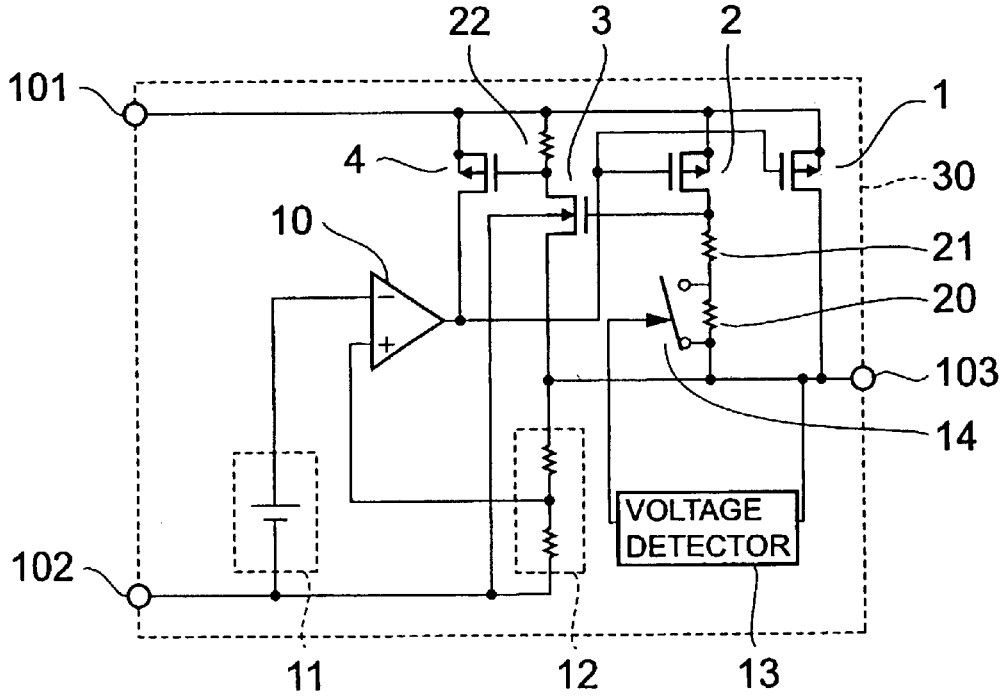
FIG. 8 is a circuit block diagram showing a configuration example of the voltage regulator according to the present invention.

FIG. 8 is a circuit block diagram showing another configuration example of a voltage regulator according to the present invention. The description related to the same portions as those in FIG. 2 is omitted here. A resistor 20 is connected between the resistor 21 and the output terminal 103 in the conventional voltage regulator shown in FIG. 2, and a switch element 14 is connected with the resistor 20 in parallel.

Figure 9:
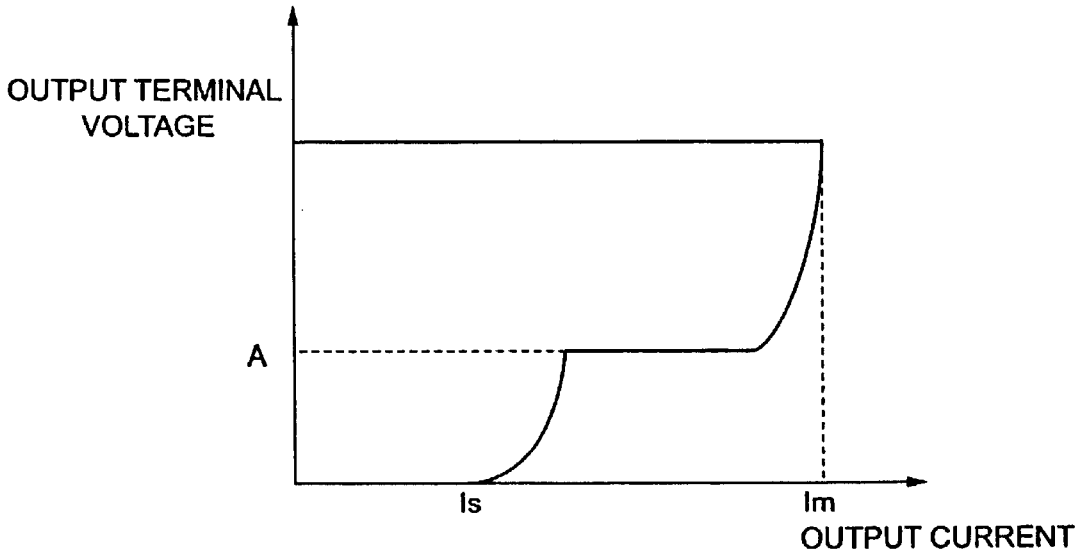
FIG. 9 shows a relationship between an output voltage and an output current in the voltage regulator shown in FIG. 8.

A voltage detector 13 detects a voltage of the output terminal 103 and outputs a control signal for turning OFF the switch element 14 when an output voltage becomes a specified voltage or lower. Hereinafter, the operation of the voltage regulator shown in FIG. 8 will be described together with the drawing indicating a relationship between an output voltage and an output current as shown in FIG. 9.

When a load into which a current larger than a specified current flows is connected with the output terminal 103, a large current tends to flow into the P-channel MOS transistor 1. Thus, a current which is determined by a channel length and a channel width with respect to the P-channel MOS transistor 1 and the P-channel MOS transistor 2 flows into the P-channel MOS transistor 2. Accordingly, a voltage between the gate and the source of the N-channel MOS transistor 3 is risen proportional to the current value. When the voltage exceeds a threshold voltage of the N-channel MOS transistor 3, as in the conventional example shown in FIG. 2, a voltage between the gate and the source of the P-channel MOS transistor 1 becomes smaller so that it tends toward an OFF state. At this time, if the output voltage is equal to or larger than a detection voltage (A) of the voltage detector 13, the switch element 14 is being turned ON.

Therefore, a voltage between the gate and the source of the N-channel MOS transistor 3 becomes (resistance value of resistor 21)×(value of current flowing into P-channel MOS transistor 2).

When the output voltage of the voltage regulator is reduced and becomes equal to or lower than the detection voltage (A) of the voltage detector 13, the voltage detector 13 detects that and turns OFF the switch element 14.

Therefore, a voltage between the gate and the source of the N-channel MOS transistor 3 becomes (resistance value of resistor 21+resistance value of resistor 20)×(value of current flowing into P-channel MOS transistor 2).

Therefore, even in the case of the same output current, a voltage between both ends of the resistors 21 and 20 is increased so that a voltage between the gate and the source of the N-channel MOS transistor 3 is increased. Thus, a voltage between the gate and the source of the P-channel MOS transistor 4 is increased. Accordingly, a voltage between the gate and the source of the P-channel MOS transistor 1 becomes smaller so that the P-channel MOS transistor 1 further approaches an OFF state. As a result, a relationship between the output current and the output voltage has such a characteristic as shown in FIG. 9.

Figure 10:
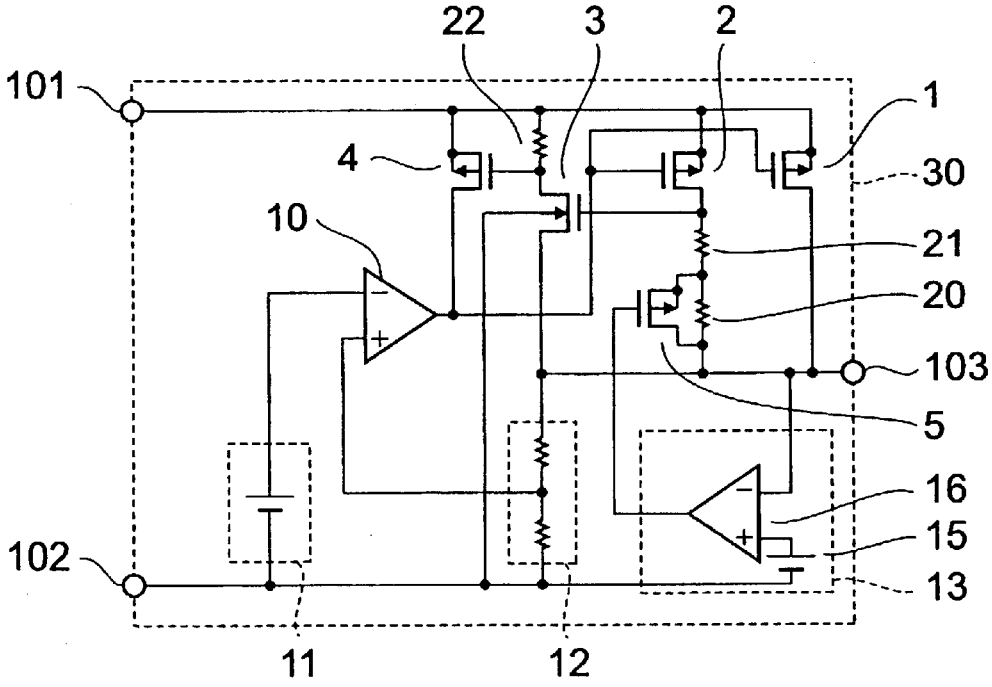
FIG. 10 is a circuit block diagram showing a configuration example of the voltage regulator according to the present invention.

FIG. 10 shows an embodiment of the configuration example shown in FIG. 8. In the voltage detector 13 shown in FIG. 1, one input of a voltage comparator 16 is used as the output terminal 103 and the other input is used as an output voltage terminal of a reference voltage source 15. The output terminal of the voltage comparator 16 is connected with the gate terminal of the P-channel MOS transistor 5. The source terminal, the base terminal, and the drain terminal of the P-channel MOS transistor 5 are connected with the resistor 20 in parallel.

When a voltage of the output terminal 103 is reduced and becomes smaller than an output voltage of the reference voltage source 15, a voltage between the gate and the source of the P-channel MOS transistor 5 becomes smaller so that the P-channel MOS transistor 5 is turned OFF. At this time, a voltage between the gate and the source of the N-channel MOS transistor 3 becomes larger. As a result, a current flowing into the P-channel MOS transistor 1 becomes smaller.

Figure 11:
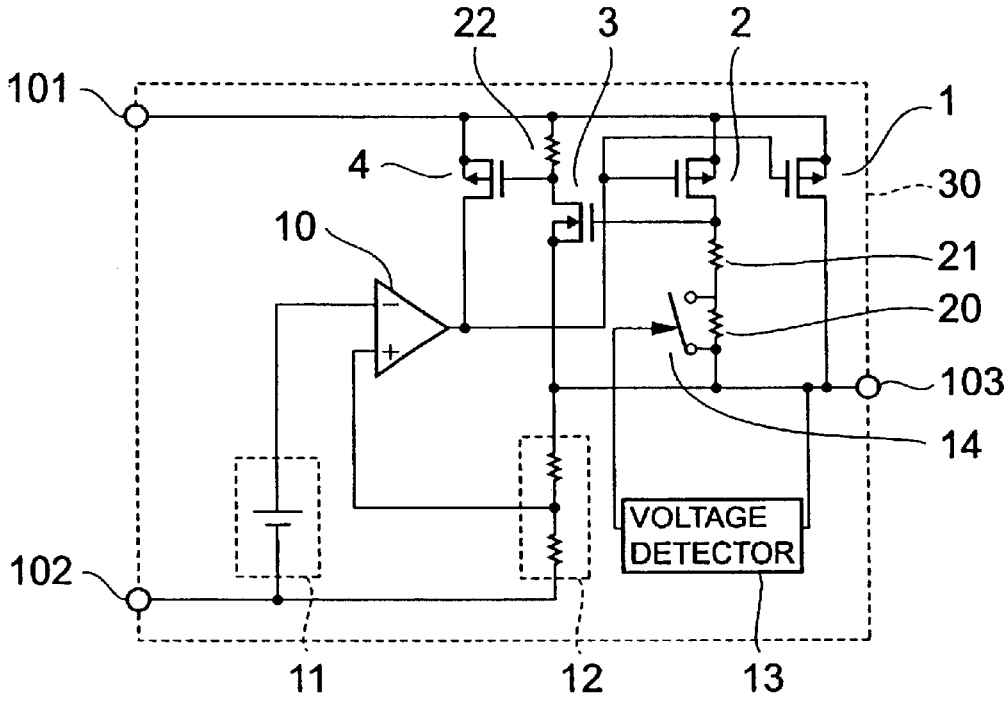
FIG. 11 is a circuit block diagram showing a configuration example of the voltage regulator according to the present invention.
Figure 12:
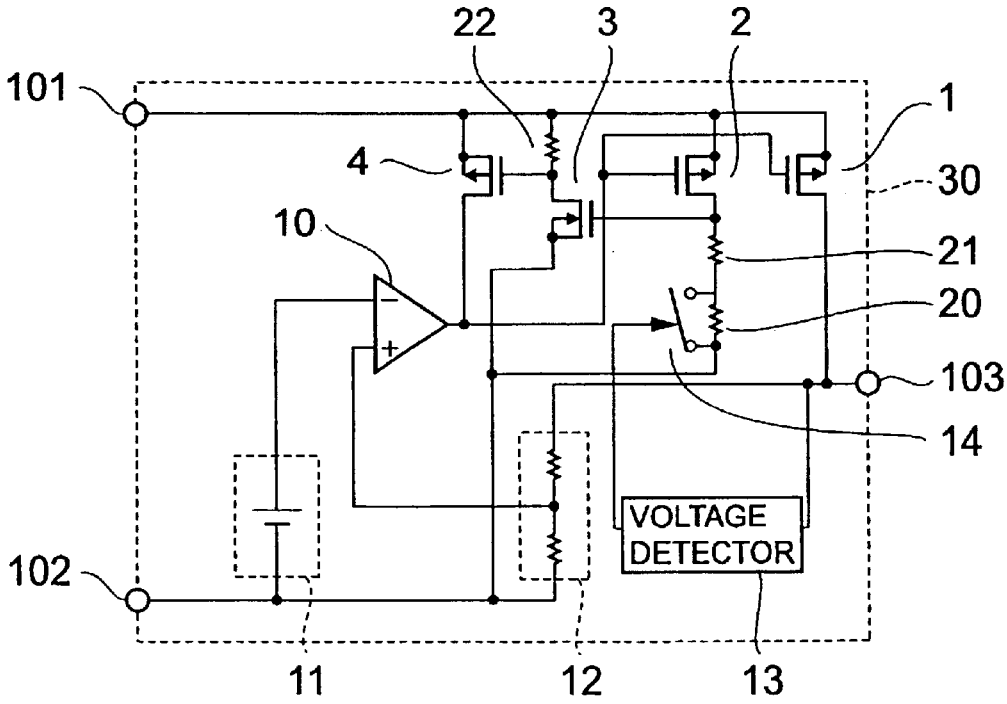
FIG. 12 is a circuit block diagram showing a configuration example of the voltage regulator according to the present invention.

At this time, in FIG. 8, the base terminal of the N-channel MOS transistor 3 is connected with the ground terminal 102. However, it may be connected with the output terminal 103 as shown in FIG. 11. In addition, as shown in FIG. 12, the base terminal and the source terminal of the N-channel MOS transistor 3 may be connected with the ground terminal 102.

Figure 13:
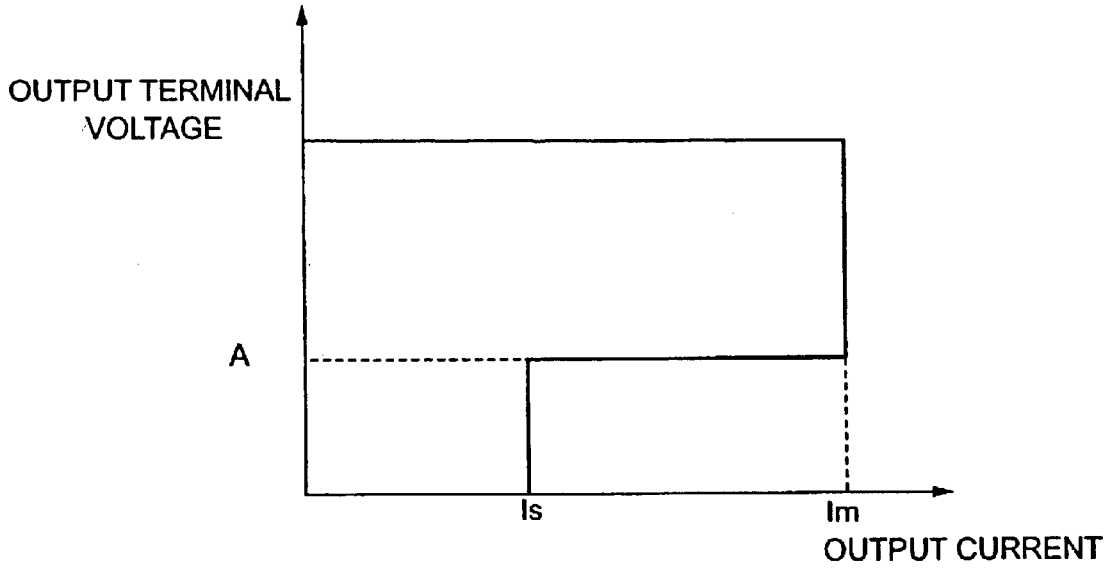
FIG. 13 shows a relationship between an output voltage and an output current in the voltage regulators shown in FIGS. 11 and 12.

A relationship between an output voltage and an output current as shown in FIG. 13 will be described. In the cases of configuration examples as shown in FIGS. 11 and 12, a source potential and a base potential of the N-channel MOS transistor 3 are equal to each other so that there is no back gate effect in the N-channel MOS transistor 3. Thus, when a current flowing into the resistor 21 becomes a certain current value or larger, the N-channel MOS transistor 3 is turned ON. Accordingly, the P-channel MOS transistor 1 is turned OFF, an output current is kept to be Im, and an output voltage is reduced until it is reduced to a detection voltage (A) of the voltage detector 13. When the output voltage becomes the detection voltage (A) of the voltage detector 13, it outputs the control signal for turning OFF the switch element 14 so that a voltage between the gate and the source of the N-channel MOS transistor 3 is risen, the P-channel MOS transistor 1 is being turned OFF, and the output current becomes Is. As a result, the characteristic as shown in FIG. 13 is obtained.

According to the voltage regulator of the present invention, the configuration is used in which a resistance value for detecting an output current is changed and a limited current can be changed according to an output voltage. Thus, there is an effect that a short circuit current can be reduced with a state in which a maximum current is greatly increased.

What is claimed is:

1. A voltage regulator for controlling a current flowing into an output voltage terminal in accordance with an output voltage, comprising:

a first MOS transistor having a first conductivity type in which a source terminal thereof is connected with an input voltage terminal and a drain terminal thereof is connected with the output voltage terminal;

a differential amplifying circuit having two input terminals in which an output terminal thereof is connected with a gate terminal of the first MOS transistor;

a first reference voltage source which is connected between one of the input terminals of the differential amplifying circuit and a ground terminal and in which an output terminal thereof is connected with the one input terminal of the differential amplifying circuit;

a voltage dividing circuit which is connected between the output voltage terminal and the ground terminal and in which an output voltage terminal thereof is connected with the other input terminal of the differential amplifying circuit;

a second MOS transistor having the first conductivity type in which a gate terminal and a source terminal thereof are connected with the gate terminal and the source terminal of the first MOS transistor, which are common to each other, respectively;

a first resistor connected between the output voltage terminal and a drain terminal of the second MOS transistor;

an MOS transistor having a second conductivity type in which a source terminal thereof is connected with the output voltage terminal, a gate terminal thereof is connected with the drain terminal of the second MOS transistor, and a base terminal thereof is connected with the ground terminal;

a second resistor connected between the input voltage terminal and a drain terminal of the MOS transistor having the second conductivity type;

a third MOS transistor having the first conductivity type in which a source terminal thereof is connected with the input voltage terminal, a gate terminal thereof is connected with the drain terminal of the MOS transistor having the second conductivity type, and a drain terminal thereof is connected with the gate terminal of the first MOS transistor;

a third resistor connected between the first resistor and the output voltage terminal; and a fourth MOS transistor having the first conductivity type in which a drain terminal and a source terminal thereof are connected with the third resistor in parallel, wherein a voltage of a gate terminal of the fourth MOS transistor is a voltage lower than a specified output voltage.

2. A voltage regulator according to claim 1, wherein the gate terminal of the fourth MOS transistor is connected with the ground terminal.

3. A voltage regulator according to claim 1, wherein the gate terminal of the fourth MOS transistor is connected with the output terminal of the voltage dividing circuit.

4. A voltage regulator according to claim 1, further comprising a second reference voltage source in which a reference voltage (V1) lower than a specified output voltage is set, wherein the gate terminal of the fourth MOS transistor is connected with the second reference voltage source.

5. A voltage regulator for controlling a current flowing into an output voltage terminal in accordance with an output voltage, comprising:

a first MOS transistor having a first conductivity type in which a source terminal thereof is connected with an input voltage terminal and a drain terminal thereof is connected with the output voltage terminal;

a voltage dividing circuit connected between a ground terminal and the output voltage terminal;

a reference voltage source;

a differential amplifying circuit in which an output terminal thereof is connected with a gate terminal of the first MOS transistor and two input terminals thereof are connected with an output terminal of the reference voltage source and an output voltage terminal of the voltage dividing circuit, respectively;

a first current limiting circuit for limiting a current value of the output voltage terminal;

a voltage detector for detecting a reduction in voltage of the output voltage terminal;

a second current limiting circuit for limiting a current value of the output voltage terminal to a limited current value or smaller of the first current limiting circuit; and a switch element for switching from the first current limiting circuit to the second current limiting circuit when the voltage of the output voltage terminal which is detected by the voltage detector is a specified voltage or lower.

6. A voltage regulator according to claim 5, wherein the second current limiting circuit includes:

a second MOS transistor having the first conductivity type in which a source terminal and a gate terminal thereof are connected with the input voltage terminal and the output terminal of the differential amplifying circuit, respectively;

a third MOS transistor having the first conductivity type in which a source terminal, a drain terminal, and a base terminal thereof are connected with the input voltage terminal, the output terminal of the differential amplifying circuit, and the ground terminal, respectively;

an MOS transistor having a second conductivity type in which a source terminal, a gate terminal, and a drain terminal thereof are connected with the output voltage terminal, the drain terminal of the second MOS transistor, and a gate terminal of the third MOS transistor, respectively;

first and third resistors connected in series between the drain terminal of the second MOS transistor and the output voltage terminal, the first resistor being connected with a drain terminal of the second MOS transistor; and a second resistor connected between the input voltage terminal and the gate terminal of the third MOS transistor, wherein the switch element is connected with the third resistor in series, and wherein the first current limiting circuit corresponds to the second current limiting circuit produced by short-circuiting the third resistor by the switch element.

7. A voltage regulator according to claim 6, wherein:

the switch element includes a fourth MOS transistor having the first conductivity type;

a drain terminal and a source terminal of the fourth MOS transistor are connected with the output voltage terminal and the first resistor, respectively;

the voltage detector includes a voltage comparator and a reference voltage source;

the reference voltage source is connected with the ground terminal;

two input terminals of the voltage comparator are connected with the reference voltage source and the output voltage terminal, respectively; and an output terminal of the voltage comparator is connected with a gate terminal of the fourth MOS transistor.

8. A voltage regulator according to claim 6 wherein a base terminal of the MOS transistor having the second conductivity type is connected with the output voltage terminal.

9. A voltage regulator according to claim 6 wherein:

the source terminal and the base terminal of the MOS transistor having the second conductivity type are connected with the ground terminal; and the first and third resistors are connected in series between the ground terminal and the drain terminal of the second MOS transistor.

10. A voltage regulator comprising:

an input terminal to which an input voltage is applied;

an output terminal from which an output voltage is outputted;

a ground terminal;

a voltage detecting circuit for outputting a voltage detection signal in response to a signal of the output terminal;

a voltage dividing circuit for dividing a voltage between the output terminal and the ground terminal;

a reference voltage source;

a differential amplifying circuit for outputting a signal in response to an output of the voltage dividing circuit and an output of the reference voltage source;

a resistor circuit in which a resistance is changed in response to the voltage detection signal from the voltage detecting circuit;

a first current limiting circuit in which an input is connected with the input terminal and an output is connected with the resistor circuit and which is controlled in response to an output of the differential amplifying circuit, the resistor circuit being connected between the first current limiting circuit and the output terminal;

a second current limiting circuit in which an input is connected with the input terminal and an output is connected with the output terminal and which is controlled in response to the output of the differential amplifying circuit;

an invert circuit for outputting a signal in response to an output of the first current limiting circuit; and a switch element which is connected between the input terminal and the differential amplifying circuit and controlled in response to an output of the invert circuit.

* * * * *